US008038011B2

(12) United States Patent
Watanabe et al.

(10) Patent No.: US 8,038,011 B2
(45) Date of Patent: Oct. 18, 2011

(54) WATERPROOF COVER AND WATERPROOF STRUCTURE FOR A DEVICE HAVING A RECORDING PORTION

(75) Inventors: Hideki Watanabe, Chiba (JP); Rikiya Kato, Chiba (JP)

(73) Assignee: Seiko Instruments Inc. (JP)

( * ) Notice: Subject to any disclaimer, the term of this patent is extended or adjusted under 35 U.S.C. 154(b) by 1661 days.

(21) Appl. No.: 11/341,756

(22) Filed: Jan. 27, 2006

(65) Prior Publication Data

US 2007/0044879 A1 Mar. 1, 2007

(30) Foreign Application Priority Data

Jan. 31, 2005 (JP) ..... 2005-024061

(51) Int. Cl.
*B65D 25/54* (2006.01)

(52) U.S. Cl. ..... 206/775
(58) Field of Classification Search ..... 206/775
See application file for complete search history.

(56) References Cited

U.S. PATENT DOCUMENTS

2006/0113203 A1* 6/2006 Daley ..... 206/320

FOREIGN PATENT DOCUMENTS

JP 2002199925 A * 7/2002

* cited by examiner

*Primary Examiner* — Matthew Luu
*Assistant Examiner* — Kendrick Liu
(74) *Attorney, Agent, or Firm* — Adams & Wilks

(57) ABSTRACT

A waterproof cover has a first cover portion made of a waterproof material for removable connection to and covering a part of a device that has a recording portion for performing recording on a recording medium that is dischargeable from the device. A second cover portion is made of a flexible waterproof material for covering the device and for removable connection to the first cover portion to form an opening portion through which the recording medium passes when discharged from the device. Connecting members removably connect the second cover portion to the first cover portion. Positioning members position the second cover portion relative to the first cover portion prior to connection of the second cover portion to the first cover portion by the connecting member.

11 Claims, 6 Drawing Sheets

WATERPROOF COVER AND WATERPROOF STRUCTURE FOR A DEVICE HAVING A RECORDING PORTION

BACKGROUND OF THE INVENTION

1. Field of the Invention

The present invention relates to a waterproof cover and a waterproof structure for a device, such as a printer, having a recording portion for performing recording on a recording medium.

2. Description of the Related Art

Up to now, there have been a large number of stationary devices that are disposed and used in a room as devices such as a printer having a recording portion for performing recording on a recording medium. However, in recent years, there have been developed a device that is reduced in size and weight and a device that can be driven by a power supply such as a battery. Also, there has been manufactured a device that not only performs recording on the recording medium but also is integrated with a computer, a finder, or a display. Those devices may be desired to be carried and used at various locations and positions by a user. In this case, there arises such a problem that moisture may enter the device, resulting in failure of the device. In particular, in the case of a device that has to be used outdoors, it is essential to conduct rainproof measures. In the device having a recording portion for performing recording on a recording medium, because there always exists an outlet for discharging the recording medium, a casing itself of the device cannot be perfectly sealed, and there is a high possibility that moisture enters the device from the outlet.

Under the above circumstances, there has been proposed a structure having a waterproof cover that covers the vicinity of the outlet for the recording medium in the device having the recording portion as disclosed in JP 7-86426 B, Japanese Utility Model Application Laid-open No. Hei 5-7466, and JP 6-47987 A. In all of the structures disclosed in those publications, only the vicinity of the outlet for the recording medium in the device is covered with the waterproof cover, and there is disposed no waterproof cover that covers portions other than the vicinity of the outlet. Although those structures provide the effect of covering the outlet for the recording medium with the waterproof cover, it is necessary to form the casing itself of the device into a waterproof structure in order to effect the waterproofing of the portions other than the outlet. In other words, in the above publications, a sufficient waterproof effect cannot be obtained unless the device itself is formed into a waterproof structure different from the stationary type, and the waterproof cover is used together. That is, the device to be used is limited to a device having the waterproof structure, and not applicable to every device. Forming the device itself into a waterproof structure leads to a complicated structure, high costs, and increased complexity of the manufacturing process of the device itself.

In order to obtain the sufficient waterproof effect with respect to all of the devices, the device may be put in a rigid waterproof case that is made of synthetic resin. However, in this case, for example, when maintenance such as the replenishment and exchange of the recording medium, or the exchange of a battery is required, work cannot be executed unless the device is removed from the waterproof case. In addition, when the user uses the device while carrying the device, there may be no location where the waterproof case from which the device has been removed is to be temporarily held during the work such as maintenance, and the waterproof case may be impeditive. Also, since the rigid waterproof case that is made of synthetic resin is normally manufactured by means of a mold, the mold must be redesigned and reproduced when the device to be accommodated in the waterproof cover is changed. As a result, the waterproof case is not suited for a multi and small-lot production from the viewpoints of the production costs and the production efficiency.

SUMMARY OF THE INVENTION

The present invention has been made in view of the above circumstances, and therefore an object of the present invention is to provide a waterproof cover which is capable of covering not only an outlet of the recording medium but also necessary portions of a device having a recording portion that performs recording on a recording medium without the necessity to form the device itself into a waterproof structure, and which does not become obstructive during a maintenance work such as the supplementation or exchange of the recording medium, and a waterproof structure including the waterproof cover.

According to the present invention, there is provided a waterproof cover, including: a first cover portion made of a waterproof material and fixed to a part of a device having a recording portion for performing recording on a recording medium; a second cover portion made of a flexible fabric waterproof material and detachably attached onto the first cover portion; and a first connecting portion and a second connecting portion for connecting the second cover portion to the first cover portion, in which in a state where both of the first connecting portion and the second connecting portion are connected, the first cover portion and the second cover portion cover an outer surface of the device except for an opening portion for allowing the recording medium discharged from the device to pass therethrough, and in which in a state where the first connecting portion is connected and the second connecting portion is disconnected, the second cover portion is moved to a position where the second cover portion does not cover the outer surface of the device, to expose to an external environment at least a part of the device except for a portion covered with the first cover portion. This structure makes it possible to efficiently effect sufficient waterproofing, and smoothly discharge the recording medium discharged from the device to the external environment. Also, the connection and disconnection of the second connecting portion make it possible to readily switch over between a waterproof state of the device and a state where a part of the device is exposed for work such as the maintenance. In this situation, since the second cover portion is kept to be connected to the first cover portion by the first connecting portion, it is unnecessary to store the second cover portion separately.

It is preferable that a guide portion for guiding the recording medium discharged from the device to the opening portion be disposed in the interior of the second cover portion since the discharge of the recording medium to the external becomes smoother.

It is preferable that the second connecting portion be easier to connect and disconnect than the first connecting portion. Also, it is preferable that the first connecting portion require a positional precision higher than that for the second connecting portion at the time of connection. The second connecting portion may be formed of a surface fastener, and the first connecting portion may be formed of a snap. With this structure, the operation of switching over between the waterproof state of the device and the state where the part of the device is exposed for the work can be conducted with ease and with high reliability, as described above.

It is preferable that the first cover portion and the second cover portion be made of a flexible fabric waterproof synthetic resin. This makes it possible for the first cover portion and the second cover portion to fittingly cover devices slightly different in size or configuration with little gap. Because the waterproof cover is not always redesigned or remanufactured for each different device, the production efficiency is increased and the production costs are reduced.

It is preferable that the first cover portion be formed as a plate that extends along one surface of the device, and the second cover portion be formed in a cubic configuration by sewing and/or welding the waterproof material. In this case, the manufacturing costs can be reduced, and the design change can be readily conducted as compared with a case where the first cover portion and the second cover portion are formed by using a molding.

It is preferable that the opening portion be positioned so that the opening portion is located at a lower portion when the device is carried while being covered with the waterproof cover. With this structure, it is unnecessary to take the entering of moisture from the opening portion into consideration in the normal use environments.

The first cover portion may be fixed to the device together with a holder for carrying the device.

According to the present invention, there is provided a waterproof structure including: the waterproof cover having any of the structures described above; and a holder attached to the device to carry the device, in which the holder is structured so that the device is covered with portions of the waterproof cover except for the opening portion, and the opening portion is positioned at a lower portion when a user carries the device by using the holder.

According to the present invention, even if the device to be waterproofed itself is not formed of a specific waterproof structure, a sufficient waterproof effect is obtained in normal use external environments, and the recording medium that is discharged from the device can be smoothly discharged to the external environment. Also, in the case of conducting work such as maintenance of the device, a part of the device can be readily exposed to the external environment, and the device can also be readily returned to the waterproof state. In this situation, the workability is excellent since the waterproof cover does not hinder the operation, and it is unnecessary to store the waterproof cover outside.

DETAILED DESCRIPTION OF THE PREFERRED EMBODIMENTS

Now, a description will be given of preferred embodiments of the present invention with reference to the accompanying drawings.

Figure 1:
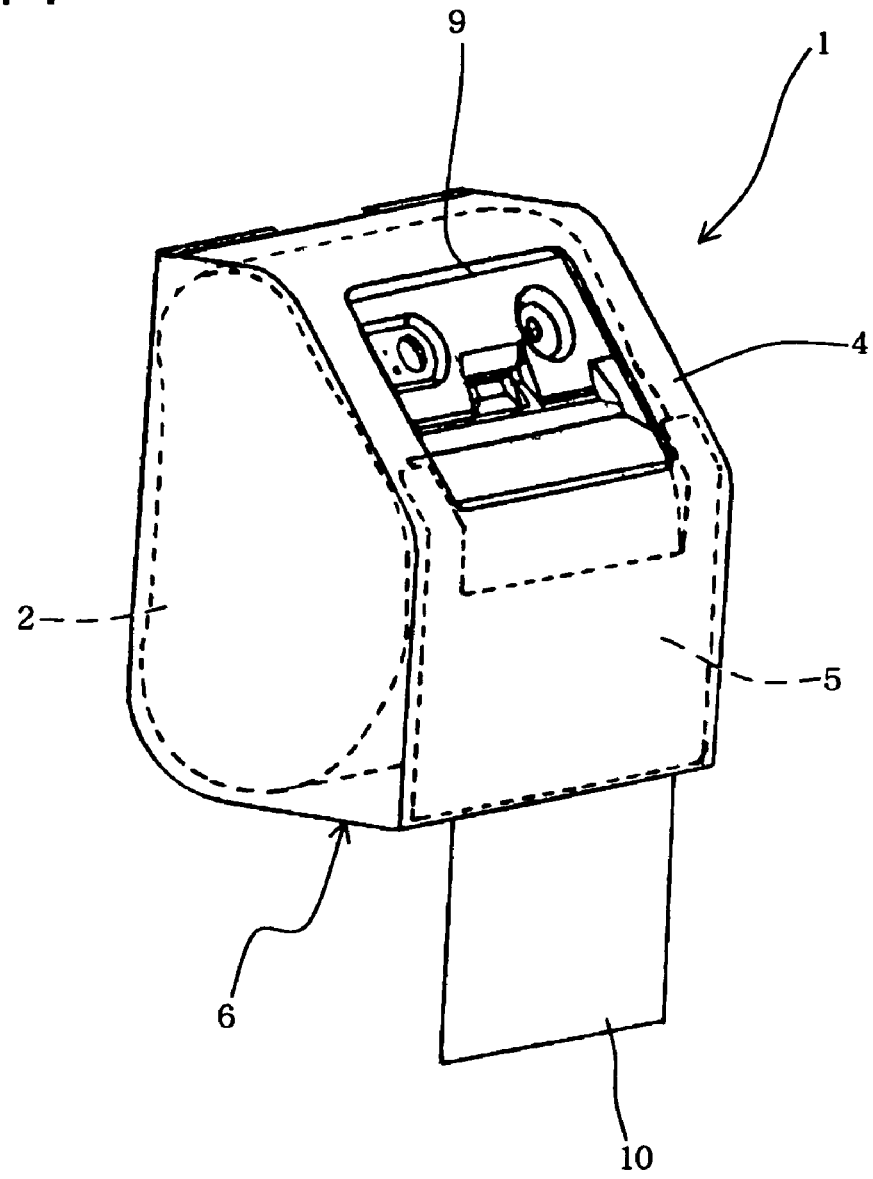
FIG. 1 is a perspective view showing a state in which a waterproof cover according to the present invention is attached to a portable printer.
Figure 2:
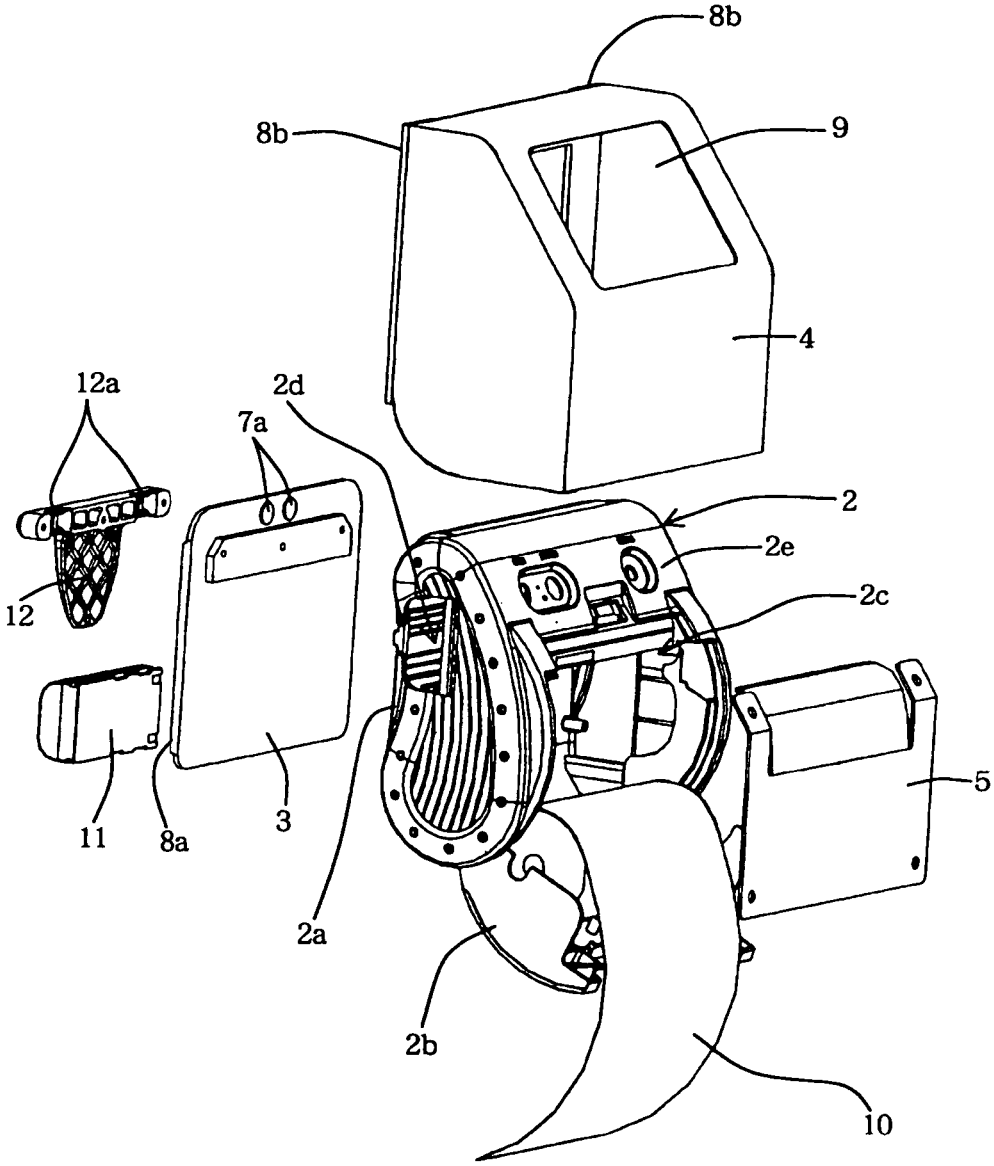
FIG. 2 is an exploded view showing a waterproof structure shown in FIG. 1.
Figure 3:
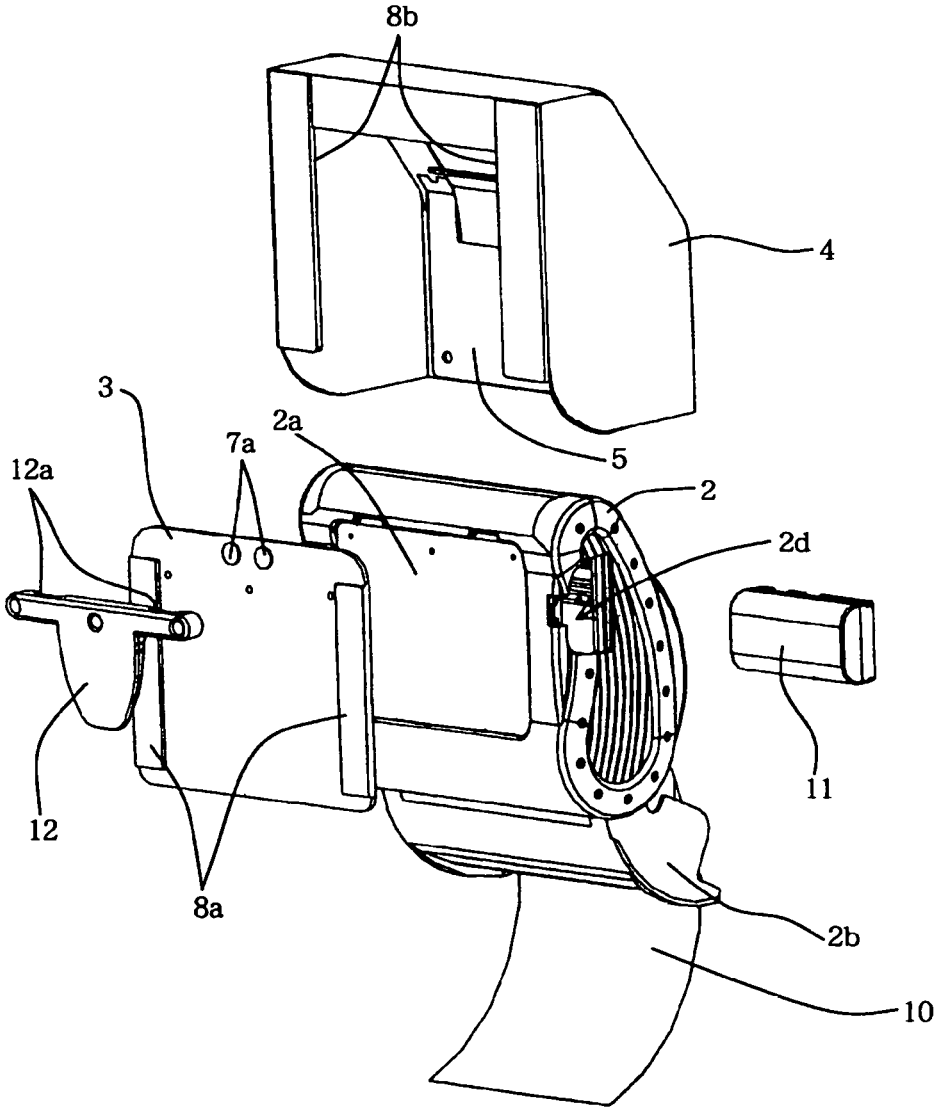
FIG. 3 is an exploded view showing the waterproof structure shown in FIG. 1, as viewed from a direction different from that of FIG. 2.

A waterproof cover 1 according to the present invention is attached to a device having a recording portion that performs printing on a recording medium, for example, a portable printer 2. FIG. 1 shows a state in which the waterproof cover 1 is attached to the portable printer 2, and FIGS. 2 and 3 are exploded views of FIG. 1.

The waterproof cover 1 according to this embodiment includes a first cover portion 3, a second cover portion 4, and a guide portion 5 that is attached to the interior of the second cover portion 4 as main structural members. The first cover portion 3 and the second cover portion 4 are connected to each other by first and second connecting portions which will be described later, and cover an outer surface of the portable printer 2 except for an opening portion 6 that is positioned at a lower portion in FIG. 1. The respective structural members of the waterproof cover 1 will be described in more detail below.

Figure 4:
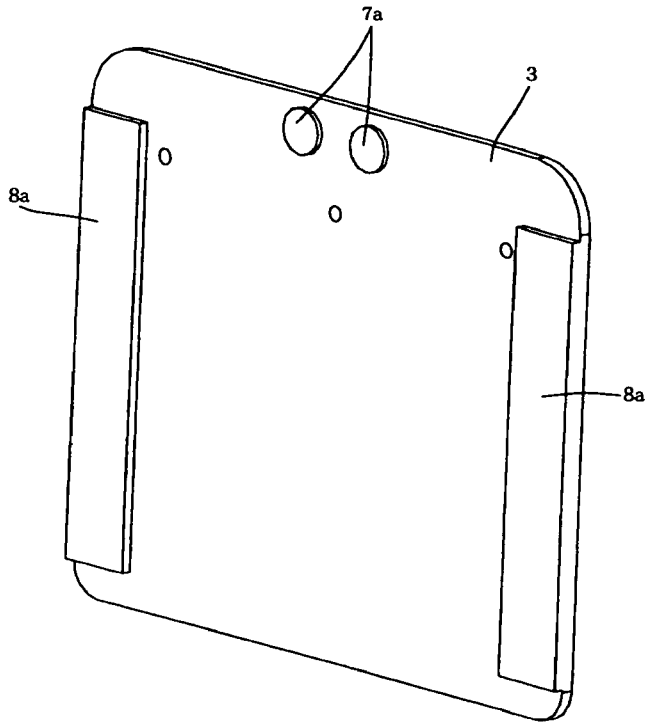
FIG. 4 is a perspective view showing a first cover portion of the waterproof cover shown in FIG. 1.

The first cover portion 3 is formed of a plate-like member made of a synthetic resin having a waterproof property such as waterproof urethane as shown in FIG. 4. The first cover portion 3 is formed in a shape in conformity with one surface of the portable printer 2, for example, a surface 2*a* (refer to FIG. 8) which becomes a bottom surface in the case where the portable printer 2 is placed on a horizontal plane and used so that the first cover portion 3 is attached to the bottom surface 2*a*. Then, there are disposed first snap members 7*a* that constitute snap-type fasteners (also called "snaps") 7 which is a first connecting portion to be described later, and first surface-type fastener members (connecting members) 8*a* that constitute surface fasteners 8 which are second connecting portions. The snap 7 and the surface fasteners 8 are made up of the first snap members 7*a* and the first surface fastener members 8*a* which are disposed in the first cover portion 3, and second snap members 7*b* and second surface fastener members 8*b* which are disposed in the second cover portion 4, respectively. The first snap members 7*a* penetrate through the first cover portion 3.

Figure 5:
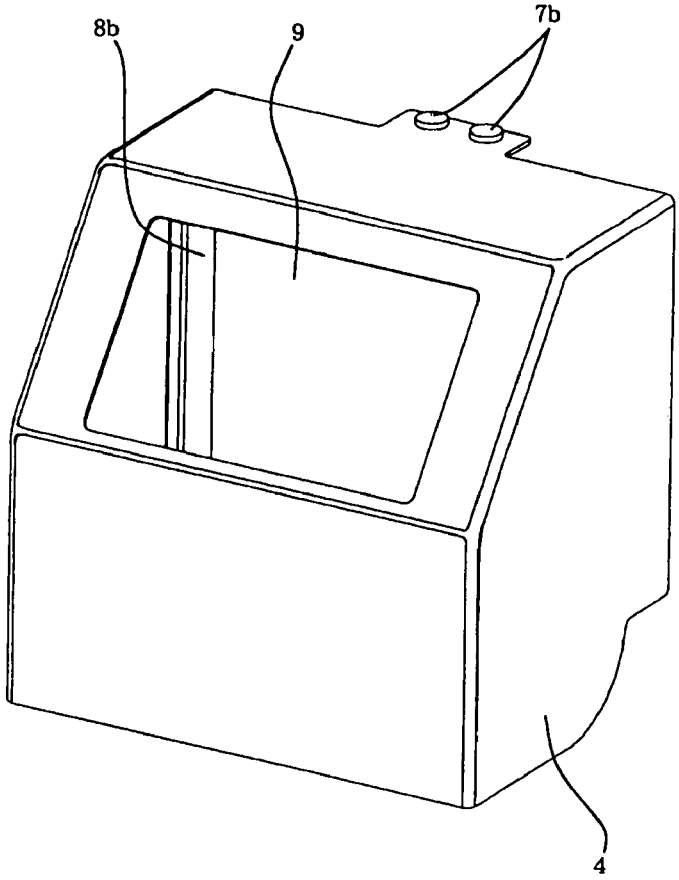
FIG. 5 is a perspective view showing a second cover portion of the waterproof cover shown in FIG. 1, as viewed from the outside.
Figure 6:
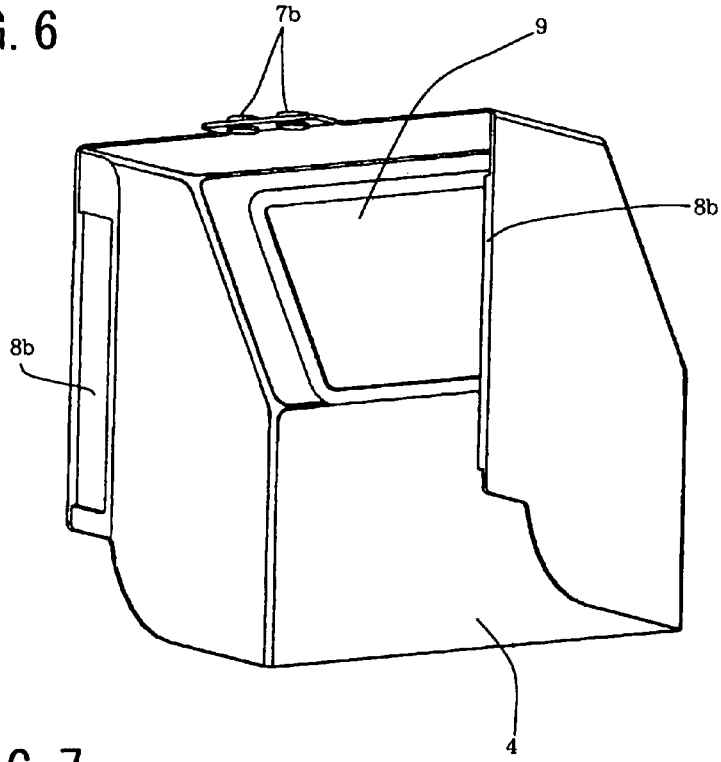
FIG. 6 is a perspective view showing the second cover portion of the waterproof cover shown in FIG. 1, as viewed from the inside.

As shown in FIGS. 5 and 6, the second cover portion 4 is formed in such a manner that a flexible fabric material made of a synthetic resin having a waterproof property such as waterproof urethane as with the first cover portion 3 is formed in a cubic configuration so as to extend along the outer surface of the portable printer 2 except for a part of the external surface of the portable printer 2, more specifically, a surface opposed to the opening portion 6 and the bottom surface 2*a*. The second cover portion 4 is equipped with the second snap members 7*b* that are disposed at positions corresponding to the first snap members 7*a* of the first cover portion 3, and the second surface fastener members 8*b* that are disposed at positions corresponding to the first surface fastener members 8*a* of the first cover portion 3. The second snap members 7*b* and the second surface fastener members 8*b* are capable of being opposed to the first snap members 7*a* and the first surface fastener members 8*a* of the first cover member 3 by partially bending the second cover portion 4 inward. Since the second cover portion 4 is made of a flexible fabric material, the user can freely bend the second cover portion 4 at an arbitrary position, and the second snap members 7*b* and the second surface fastener members 8*b* can be readily opposed to the first snap members 7*a* and the first surface fastener members 8*a* of the first cover portion 3, respectively. The second snap members 7*b* are so attached as to penetrate through the second cover 4.

The second cover portion 4 is equipped with a window portion 9 which is made of a transparent synthetic resin. The window portion 9 is disposed to allow the user to confirm the device (portable printer 2) accommodated in the interior of the waterproof cover 1. Also, the inside of the second cover portion 4 is equipped with the guide portion 5 having a curved surface for guiding the recording medium 10 discharged from the portable printer 2 to the opening portion 6.

The first cover portion 3 and the second cover portion 4 are connected to each other by the first connecting portion 7 and the second connecting portions 8. That is, the first cover portion 3 and the second cover portion 4 are connected to each other by the snap 7 that is one first connecting portion and the surface fasteners 8 that are two second connecting portions, and most of the outer surface of the portable printer 2 is covered with the first cover portion 3 and the second cover portion 4 in that state. However, the opening portion 6 is formed at a lower position in FIGS. 1 to 3 in a state where the first cover portion 3 and the second cover portion 4 are connected to each other. The portion of the portable printer 2 which faces the opening portion 6 is not covered with the waterproof cover 1.

Figure 7:
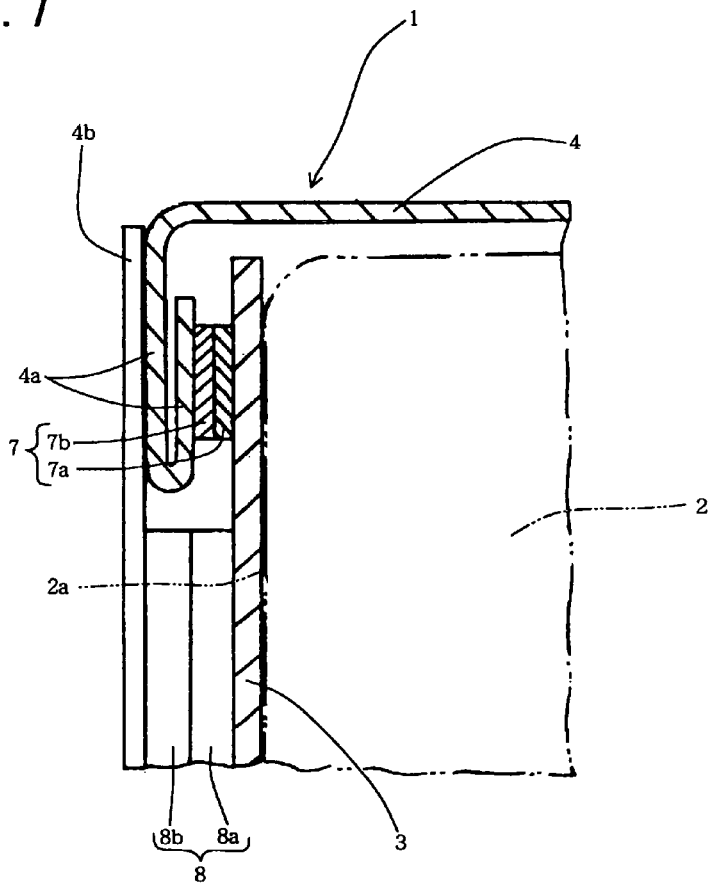
FIG. 7 is a schematic cross-sectional view showing connection between first and second connecting portions of the waterproof cover shown in FIG. 1.

The details of the connecting portions of the first cover portion 3 and the second cover portion 4 will be described with reference to FIG. 7. The first cover portion 3 is fixed to the bottom surface 2*a* of the portable printer 2 by screws or the like (not shown). In a state where the second cover portion 4 substantially covers the contour of the portable printer 2, the portion of the second cover portion 4 which is positioned above the bottom surface 2*a* of the portable printer 2 is folded inward twice whereby the second snap members 7*b* that are positioned at the fold portion 4*a* face the first snap member 7*a* of the first cover portion 3 fitted to the portable printer 2 to thereby connect the first snap members 7*a* and the second snap members 7*b* to each other. On other hand, the portion of the second cover portion 4 which is positioned by the side of the bottom surface 2*a* of the portable printer 2 is folded inward whereby the second surface fastener members 8*b* that are positioned at the fold portion 4*b* face the first surface fastener members 8*a* of the first cover portion 3 that is fixed to the portable printer 2 to thereby connect the first surface fastener members 8*a* and the second surface fastener members 8*b* to each other. Although there is usually the possibility that moisture enters the connecting portion of the snap, this embodiment is structured in such a manner that the fold portion 4*a* is folded back twice to prevent moisture from entering the interior of the waterproof cover 1, that is, the portable printer 2.

In this embodiment, after the portion of the second cover portion 4 which is positioned above the bottom surface 2*a* of the portable printer 2 is folded back to provide the fold portion 4*a*, portions of the second cover portion 4 which are positioned on both sides of the bottom surface 2*a* of the portable printer 2 are folded back to provide fold portions 4*b*. Accordingly, there is formed a portion where the fold portion 4*b* overlaps with the outside of the fold portion 4*a*. Even if the overlapped portion is thus formed, because the second cover portion 4 has the flexibility, and the surface fasteners 8 are firmly fixed in position by just allowing the first surface fastener members 8*a* and the second surface fastener members 8*b* to partially face each other, highly reliable connection can be achieved. In the respective figures other than FIG. 7, the fold portion 4*b* and the second surface fastener members 8*b* are integrated together for the simplicity of description.

Figure 8:
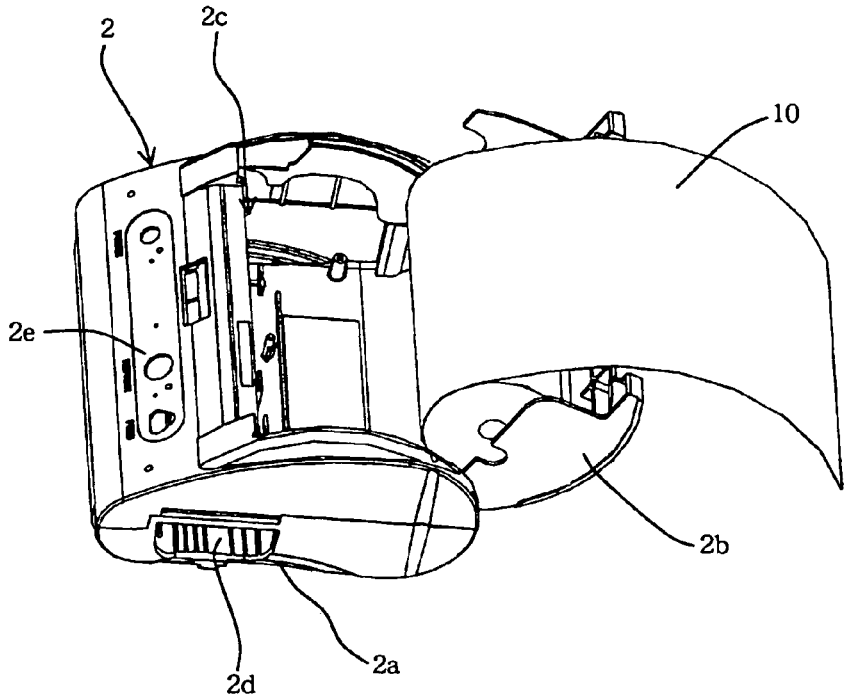
FIG. 8 is a perspective view showing a portable printer that is covered with the waterproof cover shown in FIG. 1.

Subsequently, an example of the portable printer 2 that is covered with the waterproof cover 1 according to this embodiment will be described below. The portable printer shown in FIG. 8 can be used as a stationary type, and in the case where the portable printer is used as the stationary type, the bottom surface 2*a* is placed on an installation surface such as a floor or a desk in use. The portable printer 2 includes a recording portion (not shown) therein, and is capable of recording a desired image on a recording medium 10 such as a continuous paper. The term "image" as used in this specification generically refers to colored portions such as a character, a symbol, a figure, or a pattern. Apart of the portable printer 2 is equipped with an openable and closeable cap portion 2*b*. FIG. 8 shows a state in which the cap portion 2*b* is opened.

Also, an outlet 2*c* is disposed in the vicinity of the cap portion 2*b*. More specifically, one end surface of the cap portion 2*b* constitutes one end surface of the outlet 2*c*. That is, in a state where the cap portion 2*b* is closed, a slight gap is produced between one end portion of the cap portion 2*b* and an end surface of the casing which faces the one end surface thereof, and forms the outlet 2*c*. The recording medium 10 that has undergone recording by the recording portion disposed in the interior of the portable printer 2 is discharged to the external of the portable printer 2 from the outlet 2*c*. In a state where the cap portion 2*b* is opened, because the outlet 2*c* and the vicinity of the outlet 2*c* are exposed to an external environment, there can be conducted various maintenance operations on the portable printer 2 such as removal of the recording medium 10 in order to eliminate jamming of the recording medium 10, the supplementation and exchange of the recording medium 10, or the supplementation and exchange of a recording ink. Also, the portable printer 2 is equipped with an attachment port 2*d* of a battery 11 (refer to FIGS. 2, 3, and 9), and a driving force is obtained by the battery 11. In addition, an operation panel portion 2*e* is disposed on the portable printer 2.

In this embodiment, there is disposed a strap holder 12 (refer to FIGS. 2 and 3) as an example of the holder for carrying the portable printer 2. The strap holder 12 is attached to the bottom surface 2*a* of the portable printer 2. Although not shown, the strap holder 12 has an attachment portion 12*a* to which a belt or strap which is worn on the user's body, for example, a belt worn on the user's waist or strap worn on the user's shoulder is attached. In this embodiment, the strap holder 12 is fitted to the bottom surface 2*a* of the portable printer 2 with the first cover portion 3 interposed between the strap holder 12 and the bottom surface 2*a*, and a screw (not shown) connects the strap holder 12 and the first cover portion 3 to the bottom surface 2*a* of the portable printer 2 together. In the case where the user carries the portable printer by means of the strap holder 12, the portable printer 2 always takes a constant posture according to the vertical arrangement as shown in FIGS. 1 to 3.

In the case of constituting a waterproof structure that combines the above-mentioned respective structural members together, the strap holder 12 and the first cover portion 3 are firstly fixed to the bottom surface 2*a* of the portable printer 2 by means of a screw (not shown), etc. With this structure, the user can hold and carry the portable printer 2 by using the strap holder 12 and a strap (not shown). Then, the second snap members 7*b* that are positioned at the fold portion 4*a* of the second cover portion 4 are connected to the second snap members 7*a* of the first cover portion 3. With this structure, the second cover portion 4 is so held as to prevent the second cover portion 4 from dropping out of the first cover portion 3 and the portable printer 2. Subsequently, in a state where the second cover portion 4 is so disposed as to cover the portable printer 2, both side portions are partially folded back, and the second surface fastener members 8*b* that are positioned at the fold portion 4*b* are connected to the second surface fastener members 8*a* of the first cover portion 3.

As described above, the portable printer 2 is covered with the first cover portion 3 and the second cover portion 4. However, the portion of the portable printer which faces the opening portion 6 positioned at a lower portion is not covered with the first and second cover portions 3 and 4 and is exposed to the external environment. As described above, in the case where the portable printer 2 is held by using the strap holder 12, the portable printer 2 always takes a constant posture, and the opening portion 6 is always located at a lower portion. Therefore, in the state where the waterproof cover 1 is attached to the portable printer 2, moisture does not enter the portable printer 2 from the opening portion 6 unless moisture is sent up from bottom to top. That is, in normal use environments, a sufficient waterproof effect is obtained by the waterproof cover 1, and the portable printer can be used without getting wet even when used, for example, outdoors in the rain. It is unnecessary to form the portable printer 2 itself into a specific waterproof structure.

When the portable printer 2 is used, the recording medium 10 that has undergone recording is discharged from the outlet 2*c*. According to this embodiment, the recording medium 10 that has been discharged from the outlet 2*c* is abutted against the guide portion 5, guided along the curved surface of the guide portion 5 downward, and then discharged to the external from the opening portion 6. That is, according to this embodiment, the recording medium 10 can be discharged from the portable printer 2 without removing the waterproof cover 1. Because the opening portion 6 is positioned at the lower portion as described above, the waterproof effect is not lowered by the opening portion 6 for discharging the recording medium 10.

The second cover portion 4 is formed in a cubic configuration by sewing and/or welding a flexible fabric member made of a synthetic resin such as a waterproof urethane. Because of being made of the flexible fabric, the second cover portion 4 can be put along the outer surface of the portable printer 2 by arbitrarily changing the fold amount or the fold angle of the fold portions 4*a* and 4*b* to some degree. That is, according to this embodiment, the second cover portion 4 made of the flexible fabric material can be slightly modified in shape in conformity with the configuration of the device to be waterproofed (portable printer in the example shown). In addition, the surface fasteners 8 can be firmly connected even if the relative positions of the first surface fastener member 8*a* and the second surface fastener member 8*b* are not made accurate. Accordingly, the various devices slightly different in size or configuration can be protected by using the same waterproof cover 1, and the waterproof cover 1 can fittingly cover the devices along the contour of those devices. For example, hardly no unnecessary gap that would make the device move within the waterproof cover 1 is produced.

If devices largely different in size or configuration are used, adaptation to such differences can be readily effected by changing the cutting or sewing (or welding) of the flexible fabric material. Because it eliminates the need to change the mold for forming the second cover portion as in the conventional rigid waterproof case, and proves excellent in terms of the manufacture costs and the manufacture efficiency, this embodiment is also suitable for multi and small-lot production.

Figure 9:
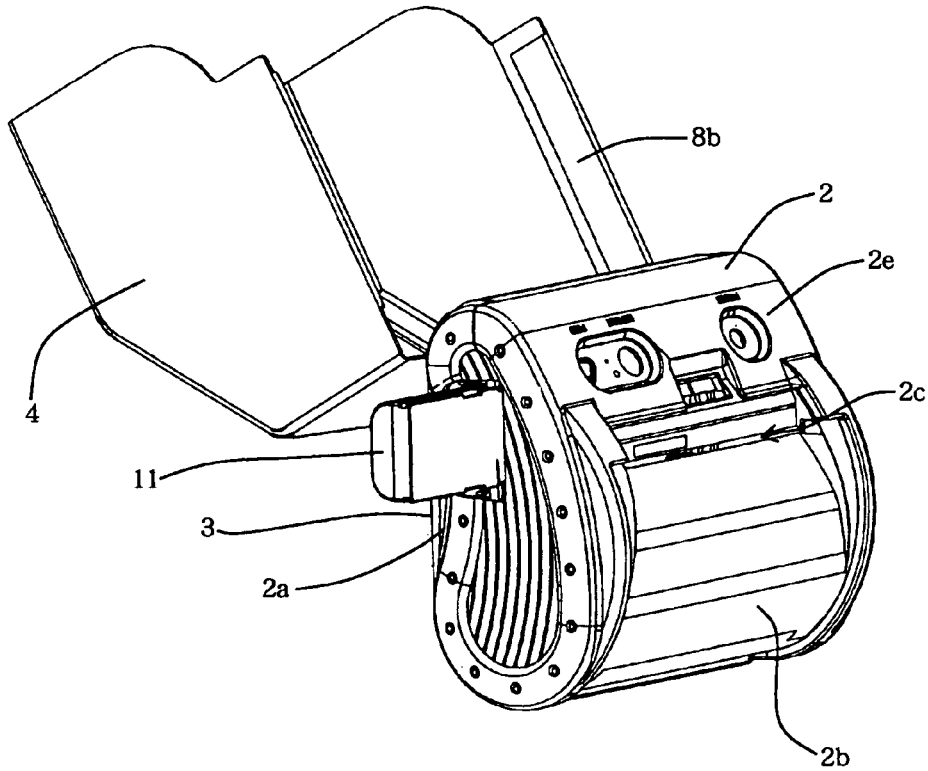
FIG. 9 is a perspective view showing a state where the second cover portion of the waterproof cover shown in FIG. 1 is moved.

In the portable printer 2 protected by the waterproof cover 1 as described above, in the case of conducting maintenance work such as the removal of a jam of the recording medium 10, the supplementation and exchange of the recording medium 10, the supplementation and exchange of the recording ink, or the installation of the battery 11, when the surface fastener 8 is removed while the snap 7 is connected, the second cover portion 4 can be moved to a position where the portable printer 2 is not covered with the second cover portion 4, with the second cover portion 4 being connected to the first cover portion 3 by only the snap 7, as shown in FIG. 9. With this structure, because the portable printer is exposed to the external except for the bottom surface 2*a*, various maintenance operations can be conducted by installing the battery 11 or opening the cap portion 2*b* as shown in FIG. 9. In this situation, since the second cover portion 4 is connected to the first cover portion 3 by the snap 7, it is unnecessary to store the second cover portion 4 at another location during the work, and also it is unnecessary for the user to grip the second cover portion 4 by his hand. In particular, because the second cover portion 4 is made of the flexible fabric material, although not shown, the second cover portion 4 can be folded back into a small size. With this operation, the second cover portion 4 does not hinder the holding of the portable printer and the maintenance work. In the case where the portable printer 2 is worn on the user's body by using the strap holder 12 and the strap (not shown), the user can conduct the work by using both of the user's hands. In this way, the workability of the maintenance or the like by the user becomes excellent.

Upon completion of the work such as maintenance, the second cover portion 4 is again returned to the position where the portable printer 2 is covered by the second cover portion 4, and the second surface fastener members 8*b* are connected to the first surface fastener members 8*a*, thereby making it possible to readily return the portable printer to the waterproof state as shown in FIG. 1.

In this embodiment, because the surface fastener 8 is used as the second connecting portion, it is very easy to conduct the operation of opening or closing the second cover portion 4 for the purpose of the maintenance work as described above. This is because the surface fasteners 8 can be firmly connected even if the relative positions of the first surface fastener members 8*a* and the second surface fastener members 8*b* are not very accurate. Also, the surface fasteners 8 are effective in enhancing the waterproof effect since there is a very low possibility of moister entering the portable printer 2 through the connecting portion.

On the other hand, this embodiment uses the snap 7 as the first connecting portion. Because the snap 7 is difficult to remove as compared with the surface fasteners 8, the snap 7 prevents the second cover portion 4 from dropping off by being erroneously detached when removing the surface fasteners 8 and moving the second cover portion 4, as shown in FIG. 1. However, when the user intentionally disconnects the snap 7 in order to remove the waterproof cover 1 from the portable printer 2, the snap 7 can be readily detached. Also, since the snap 7 cannot be connected unless the relative positional precision of the first snap members 7*a* and the second snap members 7*b* is high, the snap 7 serves as a positioning member in connecting the second cover portion 4 to the first cover portion 3.

If both of the first and second connecting portions are the surface fasteners 8, the attaching and detaching operations are easy to achieve, but the relative positioning of the first cover portion 3 and the second cover portion 4 is not conducted with high precision. As a result, there is a possibility that it may become difficult to appropriately cover the portable printer 2.

Also, when only the second connecting portion is to be detached as shown in FIG. 9, the first connecting portion is also erroneously detached. As a result, there is a fear that the second cover portion 4 may fall off. On the contrary, if both of the first and second connecting portions are snaps, positioning is always necessary at the time of installation, which is complicated and not suited to applications in which the second cover portion 4 is frequently opened and closed. Also, it is impossible to attach the waterproof cover so as to fittingly cover the devices different in the size or configuration with no gap.

As can be understood from the above, in this embodiment, the snap 7 is applied to the first connecting portion, and the surface fasteners 8 are applied to the second connecting portion, thereby making it possible to structure the waterproof cover 1 high in workability and reliability. However, the two connecting portions according to the present invention are not limited to the snap 7 and the surface fasteners 8, and any connection mechanisms having the same functions as those of the snap 7 and the surface fasteners 8 can be used.

Further, in this embodiment, the guide portion 5 for guiding the recording medium 10 to the opening portion 6 is provided, whereby the recording medium 10 can be smoothly discharged to the outside from the opening portion 10 of the waterproof cover 1 irrespective of the position of the outlet 2*c* of the portable printer 2 or the discharge direction. Note that in the examples shown in the figures, the opening portion 6 that entirely exposes one surface of the portable printer (lower surface in FIGS. 1 to 3) is provided. Alternatively, it is possible to further bend the second cover portion 4, so as to cover a part of that surface to thereby reduce the opening portion 6.

In the case where the second cover portion 4 is formed in a cubic configuration by sewing, because a specific joining device such as a welding device is not required, the manufacture costs are reduced. In this case, it is preferable that a two-sided tape or an adhesive layer be inserted between portions to be sewn together to prevent moisture from entering the portable printer from seams.

A device to be waterproofed with the waterproof cover and the waterproof structure according to the present invention is not limited to the portable printer 2, but may be any device having the recording portion that performs recording on the recording medium. For example, there may be conceived a communication equipment, a measuring device, or a computer which have the recording portion. In particular, the waterproof cover and the waterproof structure according to the present invention are very effective with respect to devices that can be used outdoors in the rain.

What is claimed is:

1. A waterproof cover for a device having a recording portion for performing recording on a recording medium that is dischargeable from the device, the waterproof cover comprising:

a first cover portion comprised of a plate-shaped member made of a waterproof material and configured to removably connect to and cover an outer surface part of the device;

a second cover portion made of a flexible waterproof material and that is configured as a structure separate and independent from the first cover portion and that removably connects to the first cover portion to form with the first cover portion an opening portion through which the recording medium passes when discharged from the device, the second cover portion having a substantially cubic-shaped configuration configured to cover outer surface parts of the device other than the outer surface part covered by the first cover portion; and a first connecting portion and a second connecting portion that removably connect the second cover portion to the first cover portion, the second connecting portion comprising surface-type fasteners mounted along a length direction of opposite side edges of each of the first and second cover portions;

wherein in a state where both the first connecting portion and the second connecting portion connect the second cover portion to the first cover portion, the first cover portion and the second cover portion cover outer surface parts of the device except for the opening portion; and wherein in a state where the first connecting portion connects the second cover portion to the first cover portion and the second connecting portion does not connect the second cover portion to the first cover portion, the second cover portion is movable to a position relative to the device so as to expose to an external environment at least a part of the outer surface of the device except for the outer surface part of the device covered by the first cover portion.

2. A waterproof cover according to claim 1; wherein the second cover portion has a guide portion that guides the recording medium discharged from the device to the opening portion.

3. A waterproof cover according to claim 1; wherein the first connecting portion comprises at least one positioning member that positions the second cover portion relative to the first cover portion before the second cover portion is connected to the first cover portion by the second connecting portion.

4. A waterproof cover according to claim 1; wherein the first connecting portion provides higher connection strength than the second connecting portion when the first cover portion and the second cover portion are connected together by the first and second connecting portions.

5. A waterproof cover according to claim 1; wherein the first connecting portion comprises a snap-type fastener.

6. A waterproof cover according to claim 1; wherein the first cover portion and the second cover portion are each made of a flexible waterproof synthetic resin.

7. A waterproof cover according to claim 1; wherein the first and second cover portions form the opening portion so as to be positioned at a lower portion of the waterproof cover when the device is carried by a user while the device is covered with the waterproof cover.

8. A waterproof cover according to claim 1; wherein the first cover portion is removably connected to the part of the device so as to be interposed between the part of the device and a holder for carrying the device.

9. A waterproof structure for a device having a recording portion, the waterproof structure comprising:

the waterproof cover according to claim 1; and a holder configured to carry and to removably connect to the device so that when a user carries the device using the holder while the device is covered with the waterproof cover, the opening portion formed by the first and second cover portions of the waterproof cover is positioned at a lower portion of the waterproof cover.

10. A waterproof cover according to claim 1; wherein the second cover portion has a window portion made of a transparent material for providing viewing access to preselected parts of the device when the second cover portions covers the device.

11. A waterproof cover according to claim 1; wherein the second cover portion comprises a plurality of flexible pieces of waterproof material welded together to form the substantially cubic configuration.

* * * * *